United States Patent [19]

Frazier

[11] Patent Number: 4,903,583

[45] Date of Patent: Feb. 27, 1990

[54] AEROSOL AIR AND DUCT TREATMENT APPARATUS FOR AIR CONDITIONING AND HEATING SYSTEMS

[76] Inventor: Reuben L. Frazier, 9103 Weymouth, Houston, Tex. 77031

[21] Appl. No.: 367,717

[22] Filed: Jun. 16, 1989

[51] Int. Cl.[4] ..... F24F 7/00

[52] U.S. Cl. ..... 98/30; 126/113; 422/306

[58] Field of Search ..... 62/78; 126/113; 98/30, 98/105, 109; 422/306

[56] References Cited

U.S. PATENT DOCUMENTS

| | | | |
|---|---|---|---|
| 3,158,081 | 11/1964 | Frost | 98/30 |
| 3,499,579 | 3/1970 | Garratt | 98/30 X |
| 3,993,444 | 11/1976 | Brown | 239/60 X |
| 4,159,672 | 7/1979 | Garguilo | 126/113 X |
| 4,166,087 | 8/1979 | Cline | 422/306 X |

*Primary Examiner*—William E. Wayner
*Attorney, Agent, or Firm*—Neal J. Mosely

[57] ABSTRACT

An aerosol air and duct treatment apparatus for treating the ducts of central air conditioning and heating systems and the air flowing therethrough is disclosed. The apparatus includes a housing which received on the exterior of a central air conditioning duct communicating with the interior of the duct downstream of the existing return air filter and fan unit for discharging air treatment chemicals into the air flowing through the duct, and is connected to the existing electrical circuitry with an adjustable timer and is manually operable by a push button switch to control the operation of an aerosol dispenser for a selective period of time and to run the existing fan unit for a selective period of time following the operation of the aerosol dispenser to distribute the air treatment chemicals throughout the ducts and into the rooms served thereby. After operation, the existing air conditioning and heating system is returned to a normal operating condition. The aerosol dispenser may be a conventional canister containing disinfecting and/or deodorizing chemcials under pressure which is easily secured within the housing and replaced when empty.

21 Claims, 1 Drawing Sheet

AEROSOL AIR AND DUCT TREATMENT APPARATUS FOR AIR CONDITIONING AND HEATING SYSTEMS

BACKGROUND OF THE INVENTION

1. Field of the Invention

This invention relates generally to air treatment apparatus for air conditioning and heating systems, and more particularly to timed aerosol apparatus for disinfecting and/or deodorizing the air and ducts of air conditioning and heating systems.

2. Brief Description of the Prior Art

Air conditioning systems having deodorizer means are known in the art. There are several patents which disclose various types of deodorizing apparatus, none of which has the combination of elements of the present system working together as a whole.

Gilbertson, U.S. Pat. No. 3,418,068 discloses an air treatment apparatus for forced air systems which gravity dispenses special deodorizing bars or sticks of gel-like material and has an air inlet, a vaporizing area, and an air outlet, with a heater disposed in the inlet to heat the air before it reaches the vaporizing area to increase the rate of vaporization of the deodorizing bars or sticks. A damper controlled by a thermostat increases air flow when the heater is energized. A manually operated and timer controlled switch energizes the heater. The electrical circuitry allows selective remote control of the heater and blower of the system.

Brown, U.S. Pat. No. 3,993,444 discloses a free-standing timer controlled room deodorizer comprising an open top container holding a paste-like deodorizer which is intermittently dispensed in vapor form. A motor is energized at predetermined time intervals to rotate a fan for specific time periods to direct air over the exposed surface of the deodorizer material. The device is not installed in air conditioning units.

Hudgins, U.S. Pat. No. 4,601,886 discloses window unit air conditioner that receives a cassette container which holds an air freshening liquid. An electrically controlled pump dispenses the liquid in a plurality of short bursts within the airstream of the air conditioning apparatus a preselected intervals.

Takemasa, U.S. Pat. No. 4,677,902 discloses a deodorizing device for automotive AC systems. A switch controls a door at the exit of a volatile deodorizer which when opened allows the deodorant to enter the air duct and be blown into the passenger compartment and/or across the evaporator coil.

The present invention is distinguished over the prior art in general, and these patents in particular by an aerosol air and duct treatment apparatus for treating the ducts of central air conditioning and heating systems and the air flowing therethrough is disclosed. The apparatus includes a housing which received on the exterior of a central air conditioning duct communicating with the interior of the duct downstream of the existing return air filter and fan unit for discharging air treatment chemicals into the air flowing through the duct, and is connected to the existing electrical circuitry with an adjustable timer and is manually operable by a push button switch to control the operation of an aerosol dispenser for a selective period of time and to run the existing fan unit for a selective period of time following the operation of the aerosol dispenser to distribute the air treatment chemicals throughout the ducts and into the rooms served thereby. After operation, the existing air conditioning and heating system is returned to a normal operating condition. The aerosol dispenser may be a conventional canister containing disinfecting and/or deodorizing chemicals under pressure which is easily secured within the housing and replaced when empty.

SUMMARY OF THE INVENTION

It is therefore an object of the present invention to provide a means for disinfecting and/or deodorizing an air supply in a residence or commercial building.

It is another object of this invention to provide aerosol apparatus for disinfecting and/or deodorizing the air and ducts of air conditioning and heating systems.

Another object of this invention is to provide aerosol apparatus for disinfecting and/or deodorizing the air and ducts of air conditioning and heating systems which will prevent the build-up of mold and fungus in the ducts and eliminate undesirable odors in an enclosure.

Another object of this invention is to provide a timed aerosol apparatus for disinfecting and/or deodorizing the air and ducts of air conditioning and heating systems which is controlled by pressing a button.

Another object of this invention is to provide an aerosol disinfecting and/or deodorizing apparatus which is easily installed in existing air conditioning and heating systems.

A further object of this invention is to provide an aerosol disinfecting and/or deodorizing apparatus which does not require special disinfecting and/or deodorizing chemicals or compounds and allows a wide selection of chemicals and deodorizing agents.

A still further object of this invention is to provide an aerosol disinfecting and/or deodorizing apparatus which is simple in design and construction, economical to manufacture, and rugged and reliable in use.

Other objects of the invention will become apparent from time to time throughout the specification and claims as hereinafter related.

The above noted objects and other objects of the invention are accomplished by an aerosol air and duct treatment apparatus for treating the ducts of central air conditioning and heating systems and the air flowing therethrough is disclosed. The apparatus includes a housing which received on the exterior of a central air conditioning duct communicating with the interior of the duct downstream of the existing return air filter and fan unit for discharging air treatment chemicals into the air flowing through the duct, and is connected to the existing electrical circuitry with an adjustable timer and is manually operable by a push button switch to control the operation of an aerosol dispenser for a selective period of time and to run the existing fan unit for a selective period of time following the operation of the aerosol dispenser to distribute the air treatment chemicals throughout the ducts and into the rooms served thereby. After operation, the existing air conditioning and heating system is returned to a normal operating condition. The aerosol dispenser may be a conventional canister containing disinfecting and/or deodorizing chemicals under pressure which is easily secured within the housing and replaced when empty.

DESCRIPTION OF THE PREFERRED EMBODIMENT

Figure 1:
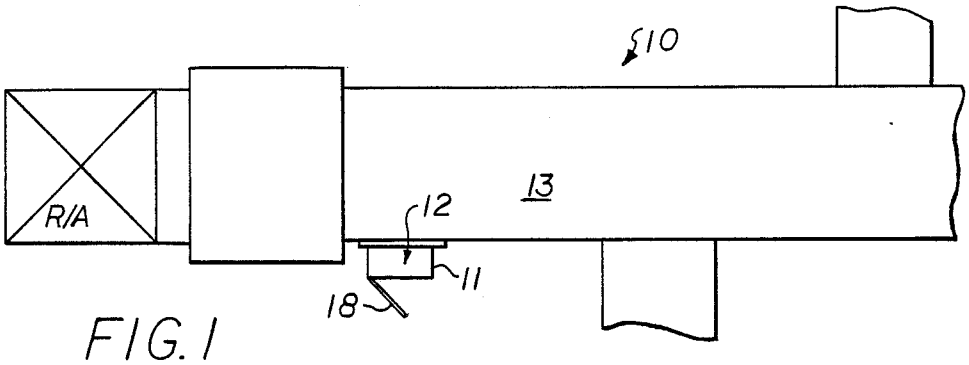
FIG. 1 is a top plan view of a portion of the ductwork of a central air conditioning and heating system having an aerosol disinfecting and/or deodorizing apparatus installed thereon.

Referring to the drawings by numerals of reference, there is shown in FIG. 1, a partial top view of a portion of the ductwork for a conventional air conditioning and heating system 10. A box-like housing 11 containing a preferred aerosol disinfecting and/or deodorizing apparatus 12 is installed on the side of the ductwork downstream of the return air filter and fan unit.

Figure 2:
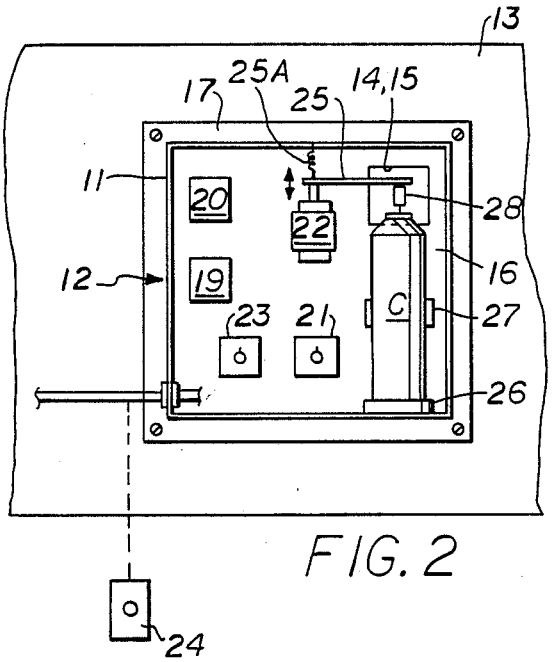
FIG. 2 is a front elevation of the preferred aerosol disinfecting and/or deodorizing apparatus in accordance with the present invention.
Figure 3:
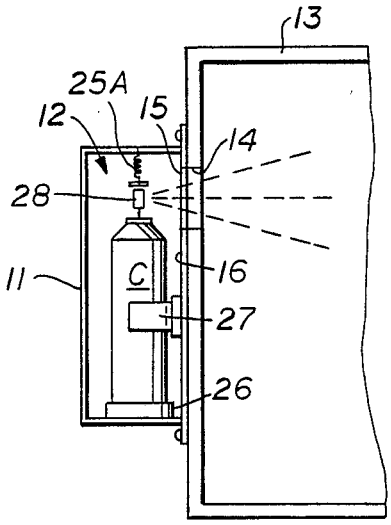
FIG. 3 is a side cross section of the aerosol disinfecting and/or deodorizing apparatus taken along line 3—3 of FIG. 2.

As represented in FIGS. 2 and 3, the existing ductwork 13 is modified to have a small opening 14 cut through the side wall. The housing 11 is also provided with a small opening 15 through its back wall 16 in alignment with the opening 14. The housing 11 has a peripheral flange 17 extending outwardly from its back wall 16 for mounting the housing to the side wall of the ductwork 13 by sheet metal screws or other conventional means. The housing 11 is provided with a hinged door 18 for easy access to the interior of the housing.

Figure 4:
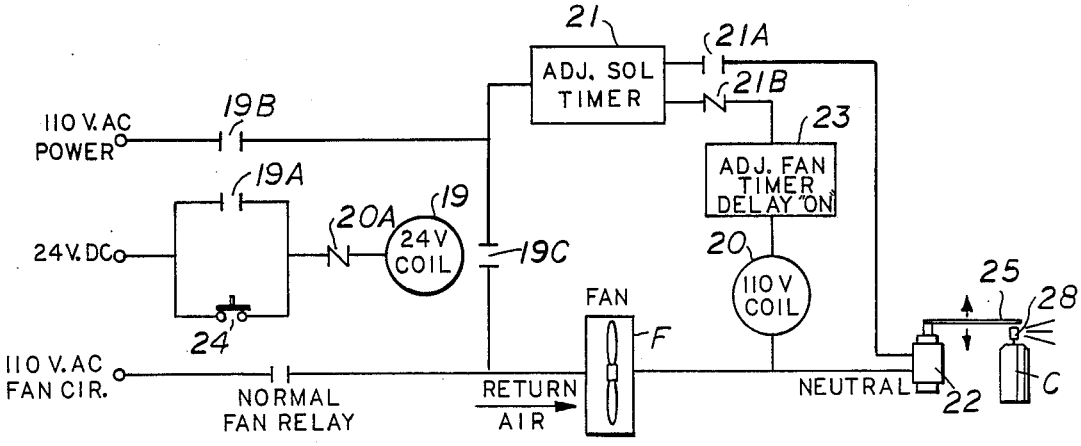
FIG. 4 is a schematic electrical diagram of the control circuitry of the aerosol disinfecting and/or deodorizing apparatus.

Referring now to FIGS. 2 and 4, a 24 volt DC relay coil 19 is mounted within the housing 11. Relay 19 has normally open (N.O.) contacts 19A, 19B, and 19C. Contact 19C controls 110 volt current to the fan F. Contact 19A controls current to a 110 volt AC relay coil 20 having contact 20A. Contact 19B is connected to an adjustable delay timer 21 mounted within the housing 11 having contacts 21A and 21B. Timer contact 21A is connected to a solenoid 22 mounted in the housing adjacent the opening 15. Timer contact 21B is connected to a "delay on" timer 23. A push button switch 24 is mounted in a convenient location for manual operation, such as on the wall of the dwelling, or on the housing 11. The push button switch 24 is connected between the 24 volt electrical source and the 24 volt DC relay coil 21.

A lever arm 25 is connected at one end to the movable arm of the solenoid 22 and extends outwardly therefrom across the opening 15. A retraction spring 25A is mounted between the lever arm 25 and the housing 11 to retract the lever arm. A cylindrical ring 26 may be mounted on the bottom wall of the housing 11 beneath the lever arm 25. A clamp member 27 is mounted on the back wall 16 or side wall of the housing 11 intermediate the bottom wall of the housing and the opening 15.

A conventional aerosol canister C containing an aerosol disinfecting and/or deodorizing chemical is removably received on the housing bottom wall or within the ring 26 and is secured within the housing 11 by the clamp member 27. When properly positioned, the opening of the discharge valve nozzle 28 at the top of the canister C is pointed toward the openings 14 and 15 through the housing and duct work, and the top surface of the discharge valve nozzle 28 is directly beneath the outwardly extended end of the lever arm 25 connected to the solenoid 22.

During normal operation, the air conditioning and heating system functions in the normal manner, and when the push button switch 24 is pushed, the aerosol dispensing system becomes operational to discharge measured amounts of the aerosol disinfecting and/or deodorizing chemical into the interior of the ductwork downstream of the filter and fan units as described below.

OPERATION

The adjustable delay timer 21 is set to operate a number of seconds to dispense a sufficient amount of the aerosol disinfectant/deodorizer chemical, and the "delay on" timer 23 is set to allow the fan F to operate a sufficient length of time to distribute disinfectant-/deodorizer chemical throughout the ductwork and into the rooms of the dwelling.

When it becomes desirable to disinfect o deodorize the ductwork or to freshen the air throughout the dwelling, the push button switch 24 is pushed. When the push button switch 24 is depressed, the 24 volt relay coil 19 is activated. The normally open contacts 19A, 19B, and 19C close. The circuit through contact 19A and 110 volt AC relay coil 20 supply power to the 24 volt relay coil 19 for the duration of the fan cycle setting determined by the adjustable timer 21.

A 110 volt power source through contact 19B activates the adjustable delay timer 21, passing power through time delay contact 21A to the solenoid 22. The movable arm of the solenoid 22 is retracted and presses the lever arm 25 down on the canister discharge nozzle 28 to discharge the disinfectant and/or deodorizer chemical through the openings 14 and 15 for the length of time determined by the adjustable timer 21.

Contact 19C delivers power to the fan F, and after the length of time set on the adjustable delay timer 21 has expired, the power is transferred from timer contact 21A to contact 21B which activates the "delay on" timer 23 and the fan F continues to run, fully dispersing the aerosol spray throughout the ducted area for the length of time set on the "delay on" timer 23.

When the length of time set on the "delay on" timer 23 expires, the power goes to the 110 volt relay coil 20, thus opening the relay coil contacts 20A and returning air conditioning and heating system to the normal operating condition. The aerosol disinfectant/deodorizer system is then ready to go again by a push of the button 24.

The present invention may be used when desired to prevent the build-up of mold and fungus in the air conditioning and heating ducts and to eliminate undesirable odors in the dwelling. The removable canister is easily installed and replaced, and allows the user to select from a wide variety of commercially available disinfectant and/or deodorizing chemicals and air freshening scents.

While this invention has been described fully and completely with special emphasis upon a preferred embodiment, it should be understood that within the scope of the appended claims the invention may be practiced otherwise than as specifically described herein.

I claim:

1. A central air conditioning and heating system having at least one duct conducting conditioned air to areas to be heated or cooled, a return air duct, a return air filter, a fan for circulating air therethrough and electric circuitry energizing and controlling said system, including aerosol air and duct treatment apparatus for treating the ducts of said central air conditioning and heating system and the air flowing therethrough comprising;

aerosol dispensing means including a housing supported on the exterior of said duct and in communication with the interior of said duct downstream of said return air filter and fan for discharging air treatment chemicals into the air flowing through said return air duct, electrical control means including adjustable timer means operatively connected to said air conditioning and heating electrical circuitry and to said aerosol dispensing means, and said electrical control and adjustable timer means including means manually operable to control the operation of said aerosol dispensing means for a selective period of time and to maintain said fan in the on condition for a selective period of time following the operation of said aerosol dispensing means sufficient to distribute the air treatment chemicals throughout the ducts and into the rooms served thereby.

2. A central air conditioning and heating system with an aerosol air and duct treatment apparatus according to claim 1 in which said duct has an opening in the wall thereof, said housing is a box-like housing having an opening through one wall aligned with said duct opening, said aerosol dispensing means includes an aerosol canister containing air treatment chemicals under pressure which is removably received and secured within said housing and having a discharge valve nozzle pointed toward said housing opening and said duct opening and operable upon depression to direct the contents discharged therefrom through said openings, and said electrical control and adjustable timer means includes means operatively linked with said aerosol canister discharge valve nozzle to maintain said discharge valve nozzle depressed for a selective period of time.

3. A central air conditioning and heating system with an aerosol air and duct treatment apparatus according to claim 2 in which said operatively linking means comprises an electric solenoid having a lever arm connected to depress said discharge valve nozzle upon activation of said solenoid.

4. A central air conditioning and heating system with an aerosol air and duct treatment apparatus according to claim 2 in which said air treatment chemicals comprise disinfectant agents.

5. A central air conditioning and heating system with an aerosol air and duct treatment apparatus according to claim 2 in which said air treatment chemicals comprise deodorizing agents.

6. A central air conditioning and heating system with an aerosol air and duct treatment apparatus according to claim 2 in which said air treatment chemicals comprise disinfectant and deodorizing agents.

7. A central air conditioning and heating system with an aerosol air and duct treatment apparatus according to claim 1 in which said housing comprises;

a generally box-like construction having a back wall and at least one side wall with a peripheral flange extending outwardly from the back wall mounting said housing to the side wall of said duct, and a door hinged to said housing side wall for access to the interior thereof.

8. A central air conditioning and heating system with an aerosol air and duct treatment apparatus according to claim 7 including receiving and securing means within said housing for removably receiving and retaining said aerosol container.

9. A central air conditioning and heating system with an aerosol air and duct treatment apparatus according to claim 8 in which said receiving and securing means comprises a clamp member within said housing removably receiving and securing said aerosol canister therein.

10. A central air conditioning and heating system with an aerosol air and duct treatment apparatus according to claim 3 in which said electric circuitry includes a source of D.C. and a D.C. circuit and a source of A.C. and an A.C. circuit, said electrical control means comprises;

a D.C. relay coil mounted within said housing and operatively connected in said D.C. circuit, to an adjustable timer means, to an A.C. relay coil, and between said source of A.C. and said fan, an A.C. relay coil mounted within said housing and operatively connected between said source of A.C. and said fan, adjustable delay timer means mounted within said housing and operatively connected to said A.C. relay coil and to said adjustable timer means for controlling the operation of said fan, said adjustable timer means being operatively connected to said D.C. relay coil, to said solenoid lever, manual switch means mounted for manual operation and operatively connected between said source of D.C. and said D.C. relay coil, whereby upon closing said manual switch, said A.C. relay coil is activated to supply direct current to said D.C. relay coil and complete a circuit through said adjustable timer means to supply power to run the existing fan and to control said solenoid actuator to operate said aerosol dispensing means for a length of time determined by the adjustable timer means, and after the length of time has expired, said adjustable timer means completing a circuit through said adjustable delay timer means to operate the existing fan for a length of time determined by the adjustable delay timer means, and said adjustable delay timer completing a circuit between said source of A.C. and said A.C. relay coil after the length of time determined by said adjustable delay timer has expired whereby the existing air conditioning and heating system is returned to a normal operating condition.

11. An aerosol air and duct treatment apparatus for a central air conditioning and heating system having at least one duct conducting conditioned air to areas to be heated or cooled, a return air duct, a return air filter, a fan for circulating air therethrough and electric circuitry energizing and controlling said system, comprising;

aerosol dispensing means including a housing adapted to be supported on the exterior of said duct and in communication with the interior of said duct downstream of said return air filter and fan for discharging air treatment chemicals into the air flowing through said return air duct, electrical control means including adjustable timer means adapted to be operatively connected to said air conditioning and heating electrical circuitry and to said aerosol dispensing means, and said electrical control and adjustable timer means including means manually operable to control the operation of said aerosol dispensing means for a selective period of time and to maintain said fan in the on condition for a selective period of time following the operation of said aerosol dispensing means sufficient to distribute the air treatment chemicals throughout the ducts and into the rooms served thereby.

12. An aerosol air and duct treatment apparatus for a central air conditioning and heating system according to claim 11 in which said duct has an opening in the wall thereof, said housing is a box-like housing having an opening through one wall aligned with said duct opening, said aerosol dispensing means includes an aerosol canister containing air treatment chemicals under pressure which is removably received and secured within said housing and having a discharge valve nozzle pointed toward said housing opening and said duct opening and operable upon depression to direct the contents discharged therefrom through said openings, and said electrical control and adjustable timer means includes means operatively linked with said aerosol canister discharge valve nozzle to maintain said discharge valve nozzle depressed for a selective period of time.

13. An aerosol air and duct treatment apparatus for a central air conditioning and heating system according to claim 12 in which said operatively linking means comprises an electric solenoid having a lever arm connected to depress said discharge valve nozzle upon activation of said solenoid.

14. An aerosol air and duct treatment apparatus for a central air conditioning and heating system according to claim 12 in which said air treatment chemicals comprise disinfectant agents.

15. An aerosol air and duct treatment apparatus for a central air conditioning and heating system according to claim 2 in which said air treatment chemicals comprise deodorizing agents.

16. An aerosol air and duct treatment apparatus for a central air conditioning and heating system according to claim 2 in which said air treatment chemicals comprise disinfectant and deodorizing agents.

17. An aerosol air and duct treatment apparatus for a central air conditioning and heating system according to claim 1 in which said housing comprises;

a generally box-like construction having a back wall and at least one side wall with a peripheral flange extending outwardly from the back wall mounting said housing to the side wall of said duct, and a door hinged to said housing side wall for access to the interior thereof.

18. An aerosol air and duct treatment apparatus for a central air conditioning and heating system according to claim 7 including receiving and securing means within said housing for removably receiving and retaining said aerosol container.

19. An aerosol air and duct treatment apparatus for a central air conditioning and heating system according to claim 8 in which said receiving and securing means comprises a clamp member within said housing removably receiving and securing said aerosol canister therein.

20. An aerosol air and duct treatment apparatus for a central air conditioning and heating system according to claim 13 in which said electric circuitry includes a source of D.C. and a D.C. circuit and a source of A.C. and an A.C. circuit, said electrical control means comprises;

a D.C. relay coil mounted within said housing and operatively connected in said D.C. circuit, to an adjustable timer means, to an A.C. relay coil, and between said source of A.C. and said fan, an A.C. relay coil mounted within said housing and operatively connected between said source of A.C. and said fan, adjustable delay timer means mounted within said housing and operatively connected to said A.C. relay coil and to said adjustable timer means for controlling the operation of said fan, said adjustable timer means being operatively connected to said D.C. relay coil, to said solenoid lever, manual switch means mounted for manual operation and operatively connected between said source of D.C. and said D.C. relay coil, whereby upon closing said manual switch, said A.C. relay coil is activated to supply direct current to said D.C. relay coil and complete a circuit through said adjustable timer means to supply power to run the existing fan and to control said solenoid actuator to operate said aerosol dispensing means for a length of time determined by the adjustable timer means, and after the length of time has expired, said adjustable timer means completing a circuit through said adjustable delay timer means to operate the existing fan for a length of time determined by the adjustable delay timer means, and said adjustable delay timer completing a circuit between said source of A.C. and said A.C. relay coil after the length of time determined by said adjustable delay timer has expired whereby the existing air conditioning and heating system is returned to a normal operating condition.

21. A method of treating a duct of a central air conditioning and heating systems and the air flowing therethrough, said system having at least one duct conducting conditioned air to areas to be heated or cooled, a return air duct, a return air filter, a fan for circulating air therethrough and electric circuitry energizing and controlling said system, comprising the steps of;

forming an opening through the side wall of said air conditioning and heating duct downstream of said return air filter and said fan, providing electrically operated and manually controlled aerosol dispensing means including adjustable timer means on the side wall of said duct disposed to discharge air treatment chemicals through said duct opening into the air flowing through the duct, connecting said electrically operated and manually controlled aerosol dispensing means to said air conditioning and heating electrical circuitry, setting said adjustable timer means to control the operation of said aerosol dispensing means for a selective period of time and to maintain said fan in the on condition for a selective period of time following the operation of said aerosol dispensing means sufficient to distribute the air treatment chemicals throughout said duct, actuating said manually controlled aerosol dispensing means to complete a circuit through said adjustable timer means to run said fan and to operate said aerosol dispensing means for a length of set on said adjustable timer means, and following the operation of said aerosol dispensing means allowing said fan to run for a length of time set on the adjustable delay timer means, and after said fan has stopped running, allowing said air conditioning and heating system to return to a normal operating condition.

* * * * *